US005364102A

United States Patent [19]

Appledorn

[11] Patent Number: 5,364,102

[45] Date of Patent: Nov. 15, 1994

[54] WEIGHTED GOLF PUTTER

[76] Inventor: James B. Appledorn, 4832 Palm Aire Dr., Sarasota, Fla. 34243

[21] Appl. No.: 124,594

[22] Filed: Sep. 22, 1993

[51] Int. Cl.[5] ..... A63B 53/14

[52] U.S. Cl. ..... 273/162 R; 273/81 A; 273/167 F

[58] Field of Search ..... 273/162 R, 81 R, 81 A, 273/73 J, 75, 67 DB, 167 F, 169, 80 R, 80 B, 170

[56] References Cited

U.S. PATENT DOCUMENTS

| | | | |
|---|---|---|---|
| 2,051,083 | 8/1936 | Hart | 273/81 A |
| 2,782,035 | 2/1957 | East | 273/81 A |
| 3,075,768 | 1/1963 | Karns | 273/81 A |
| 3,606,327 | 9/1971 | Gorman | 273/81 A |
| 4,280,700 | 7/1981 | Plagenhoef | 273/81 A |
| 4,415,156 | 11/1983 | Jorgensen | 273/81 A |
| 4,461,479 | 2/1984 | Mitchell | 273/81 A |
| 4,674,746 | 6/1987 | Benoit | 273/81 A |
| 4,690,407 | 9/1987 | Reisner | 273/81 A |
| 5,203,561 | 4/1993 | Lanctot | 273/81 A |
| 5,244,209 | 9/1993 | Benzel | 273/81 A |

FOREIGN PATENT DOCUMENTS

| | | | |
|---|---|---|---|
| 13337 | of 1911 | United Kingdom | 273/81 A |

*Primary Examiner*—Jessica J. Harrison
*Assistant Examiner*—Sebastiano Passaniti
*Attorney, Agent, or Firm*—Hugh E. Smith

[57] ABSTRACT

A golf putter weighted to be swing balanced comprising in combination a hollow tubular shaft having an interior surface and an exterior surface with a lower head end and an upper handle end; a head fabricated of solid brass with an enlarged toe and an enlarged heel for creating an increased sweet spot therebetween, the head having a sole at its lower end and HOSEL at its upper end with the lower head end of the shaft coupled to the head at the hose; a grip adapted to be held by two hands of a user and having a generally cylindrical exterior surface and a cylindrical interior surface secured over the shaft with the supper end of the grip located adjacent to the upper handle end of the shaft and with the lower end of the grip located therebeneath; a weight fabricated of lead having a cylindrical configuration with a length of about 5½ inches and weighted about 8 ounces with an interior surface and an exterior surface of about 9/16 inches, the weight being press fit into the shaft, an adhesive securing the weight to the shaft, the upper end of the weight being located coplanar with the upper end of the grip and the upper end of the shaft; and a cap having an upper exterior end and a lower interior end, the lower interior end having a planar peripheral surface in contact with the upper end of the weight, the upper end of the shaft and the upper end of the radial interior of the lower interior end of the cap having a projection press fit into the upper end of the weight.

5 Claims, 3 Drawing Sheets

WEIGHTED GOLF PUTTER

BACKGROUND OF THE INVENTION

1. Field of the Invention

The present invention relates to weighted golf putter and more particularly pertains to a putter with a weight in the upper extent of the shaft to increase swing balance.

2. Description of the Prior Art

The use of weighted golf clubs are is known in the prior art. More specifically, putters which include a weight positioned within the handle include expected and obvious structural configurations, notwithstanding the myriad of designs encompassed by the crowded prior art which have been developed for the fulfillment of countless objectives and requirements.

For example, U.S. Pat. No. 4,600,195 discloses a golf club wherein a plurality of weights are removable attached to the free end of the club shaft.

U.S. Pat. No. 4,461,479 discloses a golf club, wherein, a weighted member is mounted to the golf club between the location of the balance point and the outer end of the golf club. The weighted member has a enlarged head portion abutting the outer end of the shaft.

Additionally, U.S. Pat. No. 4,890,837 discloses a golf putter having discrete deformations provided over the majority of the shaft length including the handle. The deformations provide a variety of distinctive locations for gripping the putter.

U.S. Pat. No. 5,026,062 discloses a golf putter with means to indicate to the user whether the putter face is open, closed, or properly aligned.

Lastly, U.S. Design Pat. No. 256,824 discloses an ornamental design for a golf putter.

While these putters fulfill their respective, particular objectives and requirements, the aforementioned patents do not illustrate a golf putter which employs a cylindrical weight disposed within the shaft. Furthermore, the aforementioned patents do not illustrate a golf putter, wherein the weight is disposed at the upper extent of the shaft, underneath the users top hand.

In this respect, the weighted putter according to the present invention substantially departs from the conventional concepts and designs of the prior art, and in so doing provides a putter primarily developed for the purpose of improving the swing balance of the user.

Therefore, it can be appreciated that there exists a continuing need for new and improved golf putter which can improve swing balance. In this regard, the present invention substantially fulfills this need.

SUMMARY OF THE INVENTION

In view of the foregoing disadvantages inherent in the known types of golf clubs now present in the prior art, the present invention provides an improved weighted golf club. As such, the general purpose of the present invention, which will be described subsequently in greater detail, is to provide a new and improved weighted golf club and method which has all the advantages of the prior art and none of the disadvantages.

To attain this, the present invention essentially comprises a golf putter weighted to be swing balanced comprising in combination a hollow tubular shaft having an interior surface and an exterior surface with a lower head end and an upper handle end; a head fabricated of solid brass with an enlarged toe and an enlarged heel for creating an increased sweet spot therebetween, the head having a sole at its lower end and a HOSEL at its upper end with the lower head end of the shaft coupled to the head at the HOSEL; a grip adapted to be held by two hands of a user and having a generally cylindrical exterior surface and a cylindrical interior surface secured over the shaft with the supper end of the grip located adjacent to the upper handle end of the shaft and with the lower end of the grip located therebeneath; a weight fabricated of lead having a cylindrical configuration with a length of about 5½ inches and weighted about 8 ounces with an interior surface and an exterior surface of about 9/16 inches, the weight being press fit into the shaft, an adhesive securing the weight to the shaft, the upper end of the weight being located coplanar with the upper end of the grip and the upper end of the shaft; and a cap having an upper exterior end and a lower interior end, the lower interior end having a planar peripheral surface in contact with the upper end of the weight, the upper end of the shaft and the upper end of the radial interior of the lower interior end of the cap having a projection press fit into the upper end of the weight.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved weighted golf putter which has all the advantages of the prior art weighted golf clubs and none of the disadvantages.

It is another object of the present invention to provide a new and improved weighted golf putter which may be easily and efficiently manufactured and marketed.

It is a further object of the present invention to provide a new and improved weighted golf putter which is of a durable and reliable construction.

An even further object of the present invention is to provide a new and improved weighted golf putter which is susceptible of a low cost of manufacture with regard to both materials and labor, and which accordingly is then susceptible of low prices of sale to the consuming public, thereby making such weighted golf putters economically available to the buying public.

Still yet another object of the present invention is to provide a new and improved weighted golf putter which provides in the apparatuses and methods of the prior art some of the advantages thereof, while simultaneously overcoming some of the disadvantages normally associated therewith.

Still another object of the present invention is to reduce the number of puts per round for a golfer.

Yet another object of the present invention is to weight putters for improved swing balance.

Even still another object of the present invention is to provide a new and improved golf putter weighted to be swing balanced comprising, in combination a hollow shaft having an interior surface and an exterior surface with a lower head end and an upper handle end; a head with a toe and a heel with a sweet spot therebetween the head having a sole at its lower end and a HOSEL at its upper end with the lower head end of the shaft coupled to the head at the HOSEL; a grip having a generally cylindrical exterior surface and a cylindrical interior surface secured over the shaft with the upper end of the grip located adjacent to the upper handle end of the shaft and with the lower end of the grip located therebeneath; a weight having a cylindrical configuration, and with an interior surface and an exterior surface, the weight being positioned within the shaft, the upper end of the weight being located coplanar with the upper end of the grip and the upper end of the shaft; and a cap having an upper exterior end and a lower interior end, the interior end having a planar peripheral surface in contact with the upper ends of the weight shaft and grip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
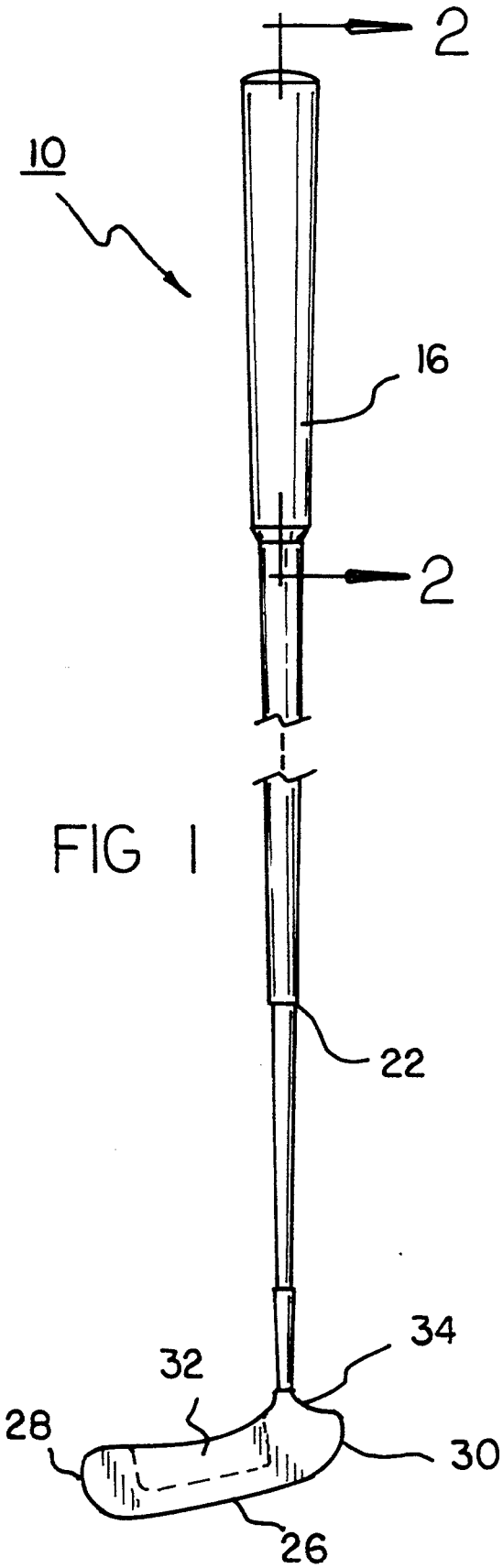
FIG. 1 is a front elevational view of a golf putter constructed in accordance with the principles of the present invention.

With reference now to the drawings, and in particular to FIG. 1 thereof, a new and improved weighted golf putter embodying the principles and concepts of the present invention and generally designated by the reference numeral 10 will be described.

The present invention relates to a golf putter 10 with a weight 12 disposed within the shaft 14 of the putter such that the putter is swing balanced by having the putter swing balanced, the player will immediately gain greater control over his or her putting stroke. Putting will be done with greater control and confidence with increased accuracy and reduced putts and scores.

In its broadest terms, the putter 10 includes a shaft 14, a grip 16, a weight 12, and a cap 18. The shaft 14 is a hollow shaft having an interior surface and an exterior surface. The shaft further includes a lower head end and an upper handle end. The shaft includes steps 22 where at the segment therefore is of a greater diameter, interiorally and exteriorly than the region thereabove. Each region, however, is cylindrical throughout its length.

In the preferred embodiment, the head 26 of the putter 10 is fabricated from solid brass. However, the head of the putter could be constructed from any conventional putter materials. The head is configured with an enlarged toe 28 and an enlarged heel 30. The enlarged toe and heel serve to create an increased sweet spot 32 intermediate the toe and heel. The head further includes a sole at its lower end and a HOSEL at its upper end, with the lower head end of the shaft connected to the head at the HOSEL 34. Although the configuration of the head has been described in detail, it is within the scope of the present invention to configure the head of the putter in any conventional manner.

Figure 2:
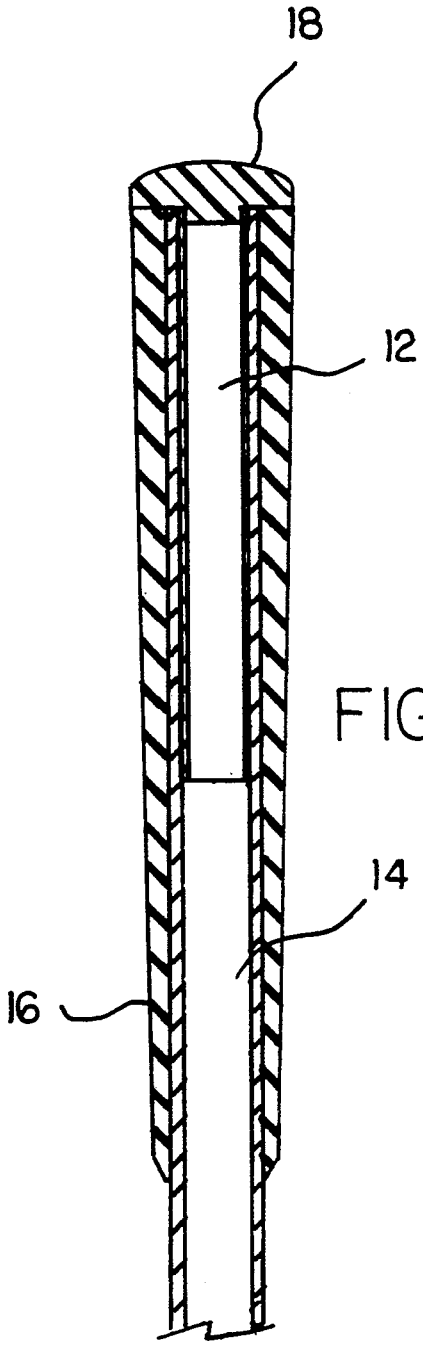
FIG. 2 is a cross section of the putter of FIG. 1 taken through line 2—2 of FIG. 1.
Figure 3:
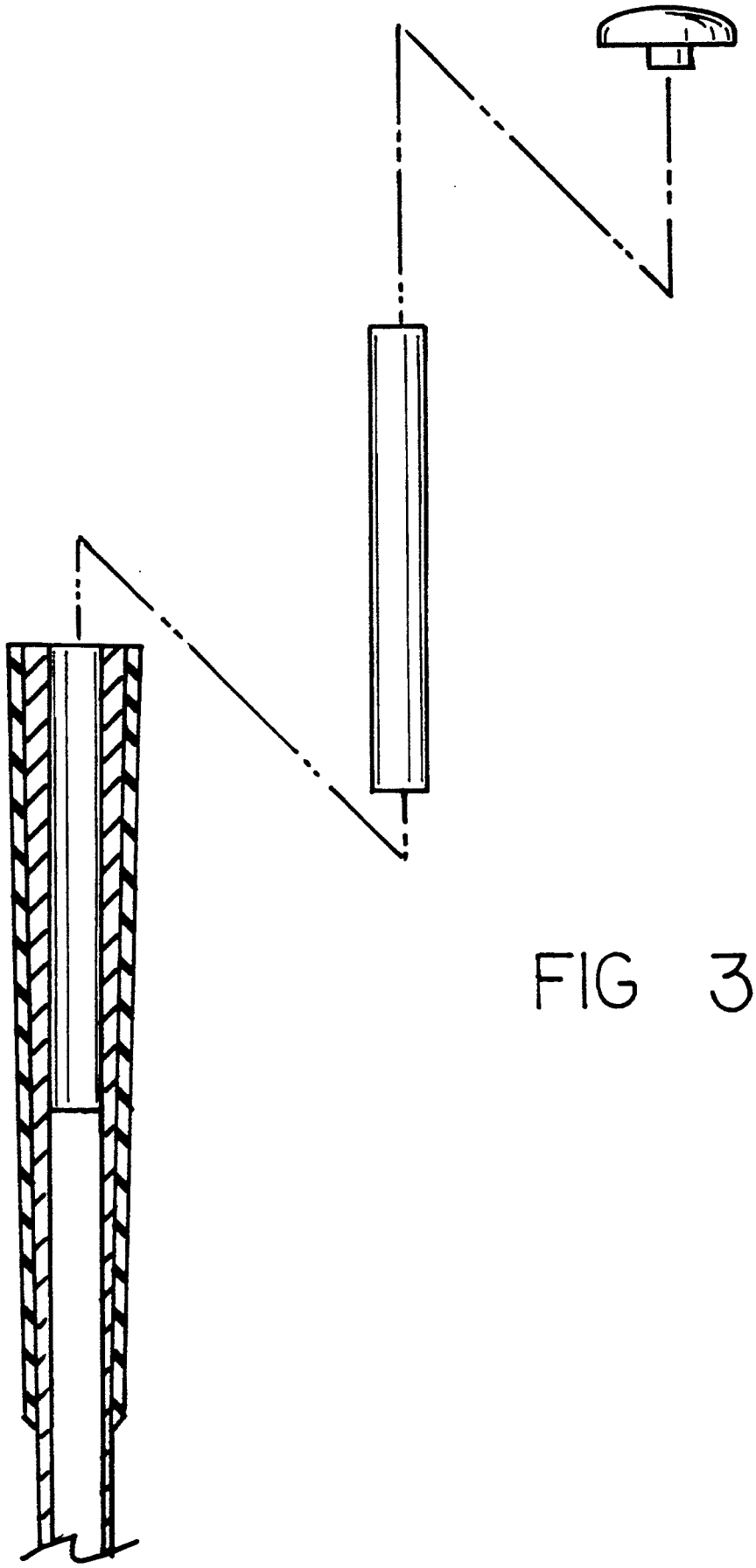
FIG. 3 is an exploded view of the putter of FIGS. 1 and 2.
Figure 4:
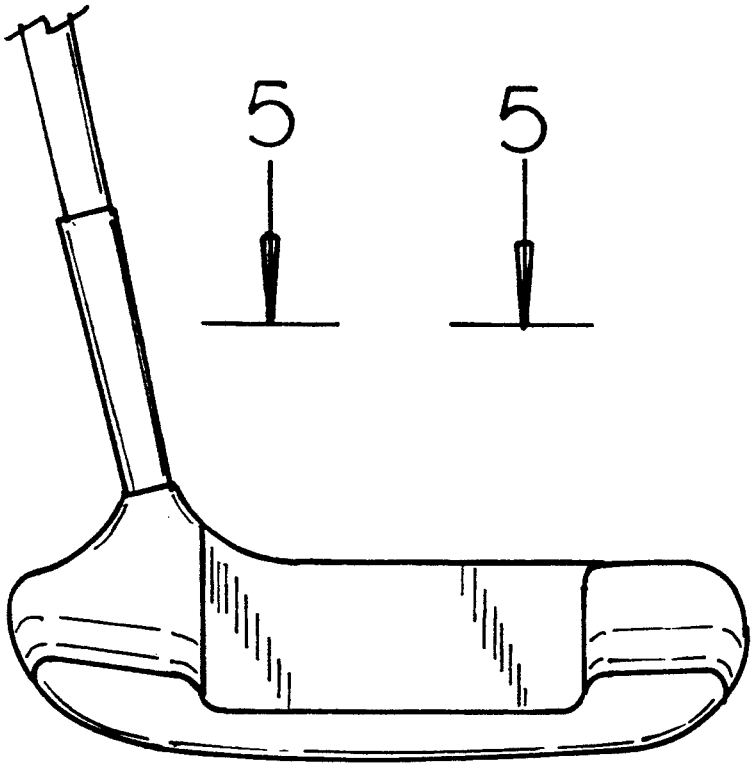
FIG. 4 is a rear elevational view of the head of the putter of the prior figures.
Figure 5:
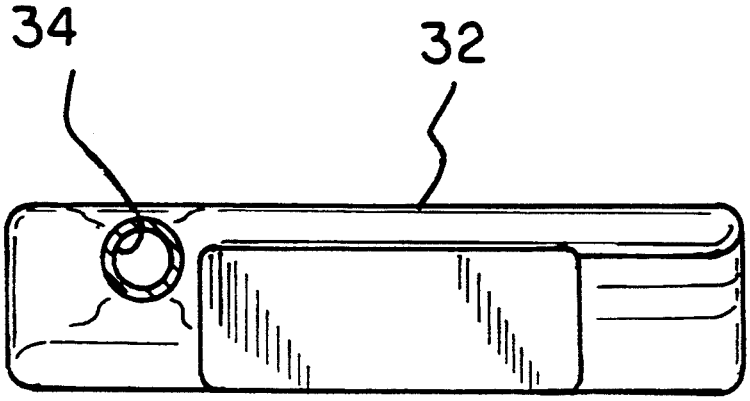
FIG. 5 is a sectional view of the putter in FIG. 2 taken along line 5—5 of FIG. 4.

The grip 16 of the putter 10 incorporates a generally cylindrical exterior surface and a cylindrical interior surface secured over the shaft. The exterior surface of the grip 16 may taper downwardly for greater comfort. The grip includes an upper end located adjacent the upper handle end of the shaft. The grip further includes a lower end located beneath the upper handle end. Note the FIG. 2 showing for an illustration of this configuration and relationship of parts.

The weight 12 positioned within the shaft 14 is fabricated of a heavy material, preferably lead and has a cylindrical configuration. Although lead is described in the preferred embodiment, other hard dense, materials, preferably metals will work.

The length of the weight 12 is about 5½ inches with an internal diameter of about 9/16 of an inch. The weight 12 includes both an interior and exterior surface. The positioning of the weight within the shaft is achieved through a press fit with additional securement being achieved with an adhesive.

The location, size and fit of the weight 12 within the shaft 14 is such that the upper end of the weight is located coplanar with the upper end of the grip and shaft. Positioning the weight as thus described places the weight such that it underlines the upper half of the grip 16 and the entire upper hand of the users grip. By concentrating the weight under the upper hand of the golfer, a better swing balance is achieved. The upper hand is defined as the left hand for right handed golfers and the right hand for left handed golfers.

A cap 18 serves to seal the upper end of the grip from deteriorating moisture. The cap includes an upper exterior face or end and a lower interior face or end. The interior end of the cap defines a planar peripheral surface 38 which is in contact with the upper ends of the weight, the shaft, and the grip. Furthermore, the interior end of the cap includes an extended portion or projection 40 located within the interior of the upper end of the weight 12.

The construction of the putter 10 as described deviates from conventional construction in two important aspects. The most important being the weight 12 positioned within the handle end of the shaft. The second differing aspect is the configuration and weighing of the head. The weight configuration, single location and weight, is selected to best exploit the benefits of the weighted shaft. Overall, these two aspects provide the golfer with as increased swing balance. The swing balance improves the smoothness and accuracy of the head's path of travel during a putt. Furthermore, the putter of the present invention enables the golfer to concentrate upon the swing of the grip, rather than upon the swing of the head. Tests have shown that all golfers experience a reduction in the number of strokes per round by having longer putts and abating three per green. This all results in an overall reduction in strokes per round.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf putter weighted to be swing balanced comprising: in combination;

a hollow tubular shaft having an interior surface and an exterior surface with a lower head end and an upper handle end;

a head fabricated of solid brass with an enlarged toe and an enlarged heel for creating an increased sweet spot therebetween, said head having a lower end and an upper end, the head having a sole at said lower end and a hosel at said upper end with the lower head end of the shaft coupled to the head at the HOSEL;

a grip adapted to be held by two hands of a user and having a generally cylindrical exterior surface and a cylindrical interior surface secured over the shaft with an upper end of the grip located adjacent to the upper handle end of the shaft and with a lower end of the grip located therebeneath;

a weight fabricated of lead having a cylindrical configuration with a length of about 5½ inches and weighted about 8 ounces with an interior surface and an exterior surface and with an internal diameter of about 9/16 inches, the weight being press fit into the shaft, an adhesive securing the weight to the shaft, an upper end of the weight being located coplanar with the upper end of the grip and the upper handle end of the shaft; and a cap having an upper exterior end and a lower interior end, the lower interior end having a planar peripheral surface in contact with the upper end of the weight, the upper handle end of the shaft and an upper end of a radial interior of the lower interior end of the cap having a projection press fit into the upper end of the weight.

2. A golf putter weighted to be swing balanced comprising, in combination:

a hollow shaft having an interior surface and an exterior surface with a lower head end and an upper handle end;

a head with a toe and a heel with a sweet spot therebetween, said head having a lower end and an upper end, the head having a sole at said lower end and a HOSEL at said upper end with the lower head end of the shaft coupled to the head at the HOSEL;

a grip having a generally cylindrical exterior surface and a cylindrical interior surface secured over the shaft with an upper end of the grip located adjacent to the upper handle end of the shaft and with a lower end of the grip located therebeneath;

a weight having a cylindrical configuration with an interior surface and an exterior surface, the weight being positioned within the shaft, an upper end of the weight being located coplanar with the upper end of the grip and the upper handle end of the shaft; and a cap having an upper exterior end and a lower interior end, the interior end having a planar peripheral surface in contact with the upper ends of the weight, shaft and grip.

3. The golf putter of claim 2 wherein the weight is sized and positioned within the shaft such that it underlies an upper half of the grip.

4. The golf putter of claim 3 wherein the weight is about 5½ inches in length.

5. The golf putter of claim 3 wherein the weight is about 8 ounces.

* * * * *